US009038295B2

(12) United States Patent
Callahan et al.

(10) Patent No.: US 9,038,295 B2
(45) Date of Patent: May 26, 2015

(54) APPARATUS PERTAINING TO PHYSICALLY-DISCRETE SIGN COMPONENTS

(71) Applicant: iLight Technologies, Inc., Chicago, IL (US)

(72) Inventors: Sean Edward Callahan, Elmhurst, IL (US); James Cuppini, West Chicago, IL (US); Mark Joseph Cleaver, Chicago, IL (US); Timothy Edward Canzano, Glen Ellyn, IL (US); Edward Wayted Chen, Chicago, IL (US); Elizabeth Marie Randgaard, Evanston, IL (US); Chad Glenn Kirschner, West Dundee, IL (US); Stephen Michael Oshgan, Des Plaines, IL (US); Paresh Shroff, Palatine, IL (US); Joseph Z. Wascow, Vernon Hills, IL (US); Nicholas Patrick Jackson, Carol Stream, IL (US); Brian Alan Retzke, Downers Grove, IL (US); Daniel John Williams, Chicago, IL (US)

(73) Assignee: iLight Technologies, Inc., Chicago, IL (US)

( * ) Notice: Subject to any disclaimer, the term of this patent is extended or adjusted under 35 U.S.C. 154(b) by 0 days.

(21) Appl. No.: 14/527,408

(22) Filed: Oct. 29, 2014

(65) Prior Publication Data

US 2015/0040444 A1 Feb. 12, 2015

Related U.S. Application Data

(63) Continuation of application No. 14/237,243, filed as application No. PCT/US2012/049970 on Aug. 8, 2012, now Pat. No. 8,887,422.

(60) Provisional application No. 61/521,194, filed on Aug. 8, 2011.

(51) Int. Cl.
*G09F 13/28* (2006.01)
*G09F 13/04* (2006.01)

(52) U.S. Cl.
CPC ..... *G09F 13/0404* (2013.01)

(58) Field of Classification Search
CPC ..... G09F 13/0404
USPC ..... 40/551, 552
See application file for complete search history.

(56) References Cited

U.S. PATENT DOCUMENTS 178,506 A * 6/1876 Brumfield ..... 40/552
873,921 A * 12/1907 Chester ..... 40/552

(Continued)

FOREIGN PATENT DOCUMENTS

| | | |
|---|---|---|
| KR | 1020100033149 | 3/2010 |
| MD | 3869 | 3/2009 |
| WO | 2013022952 | 2/2013 |

OTHER PUBLICATIONS

International Search Report and Written Opinion issued on Feb. 27, 2013 in PCT/US2012/049970.

*Primary Examiner* — Gary Hoge
(74) *Attorney, Agent, or Firm* — Fitch Even Tabin & Flannery LLP

(57) ABSTRACT

A physically-discrete sign component comprises an internally-electrically-illuminated alphabetic character having a front-facing profile and at least one connecting bar disposed at least substantially horizontally with respect to the front-facing profile of the alphabetic character and at least partially within the front-facing profile of that alphabetic character. By one approach the physically-discrete sign component includes two of the connecting bars. If desired, these two connecting bars are disposed at least substantially parallel to one another. By one approach, a first one of the connecting bars extends partially, but not wholly, above an upper periphery of the aforementioned front-facing profile while the second connecting bar extends partially, but not wholly, below a lower periphery of the front-facing profile. The connecting bars can include a connecting-bar interface configured to physically and electrically interconnect to an adjacent sign component.

20 Claims, 9 Drawing Sheets

(56) References Cited

U.S. PATENT DOCUMENTS

| | | | | | |
|---|---|---|---|---|---|
| 1,915,801 | A | * | 6/1933 | Raymond | 40/551 |
| 2,853,819 | A | * | 9/1958 | Leesch | 40/545 |
| 4,155,185 | A | | 5/1979 | Lemelson | |
| 4,471,350 | A | * | 9/1984 | Chow | 345/43 |
| 4,532,579 | A | * | 7/1985 | Merryman | 362/239 |
| 4,818,207 | A | | 4/1989 | Heron | |
| 5,020,253 | A | * | 6/1991 | Lie et al. | 40/576 |
| 5,159,772 | A | * | 11/1992 | Akaley | 40/545 |
| 6,305,110 | B1 | * | 10/2001 | Chang | 40/576 |
| 6,711,262 | B1 | | 3/2004 | Vatanen | |
| 6,745,507 | B2 | * | 6/2004 | Golding | 40/564 |
| 6,826,860 | B2 | | 12/2004 | Ko | |
| 6,868,391 | B1 | | 3/2005 | Hultgren | |
| 7,258,267 | B2 | | 8/2007 | Choi | |
| 7,685,753 | B2 | * | 3/2010 | Slowski | 40/550 |
| 2006/0245190 | A1 | | 11/2006 | Thompson | |
| 2007/0255662 | A1 | | 11/2007 | Tumminaro | |
| 2008/0011825 | A1 | | 1/2008 | Giordano | |
| 2010/0115811 | A1 | * | 5/2010 | Koper | 40/546 |

* cited by examiner

APPARATUS PERTAINING TO PHYSICALLY-DISCRETE SIGN COMPONENTS

RELATED APPLICATION(S)

This application is a continuation of U.S. patent application Ser. No. 14/237,243 filed May 2, 2014 entitled APPARATUS PERTAINING TO PHYSICALLY-DISCRETE SIGN COMPONENTS, which is a 371 Application of PCT/US2012/049970 filed Aug. 8, 2012, which claims the benefit of U.S. Provisional application No. 61/521,194, entitled FAUX-NEON SINGULATED CHARACTERS AND SYSTEM and filed Aug. 8, 2011, which is incorporated by reference in its entirety herein.

TECHNICAL FIELD

This invention relates generally to electrically-illuminated signs.

BACKGROUND

Signs of various kinds are well known in the art and typically serve to convey information to the onlooker. Even relatively simple signs, however, that comprise, for the most part, only alphanumeric content rendered in a simple typeface are often professionally rendered in order to assure a consistent and aesthetically-pleasing result. Professional rendering, of course, often contributes to the cost of the sign.

Many signs are electrically illuminated from within. Such illumination can be owing to any of a variety of technologies including but not limited to signs having alphanumeric characters formed of neon lights. Electrically illuminated signs are easier to locate and read than non-illuminated signs when ambient conditions are dark and are sometimes even useful for those same properties during daylight hours. Again, however, such signs are often professionally constructed on a custom basis (and hence can be relatively expensive) or offer only generic information (such as "OPEN").

BRIEF DESCRIPTION OF THE DRAWINGS

The above needs are at least partially met through provision of the apparatus pertaining to physically-discrete sign components described in the following detailed description, particularly when studied in conjunction with the drawings, wherein.

Figure 1:
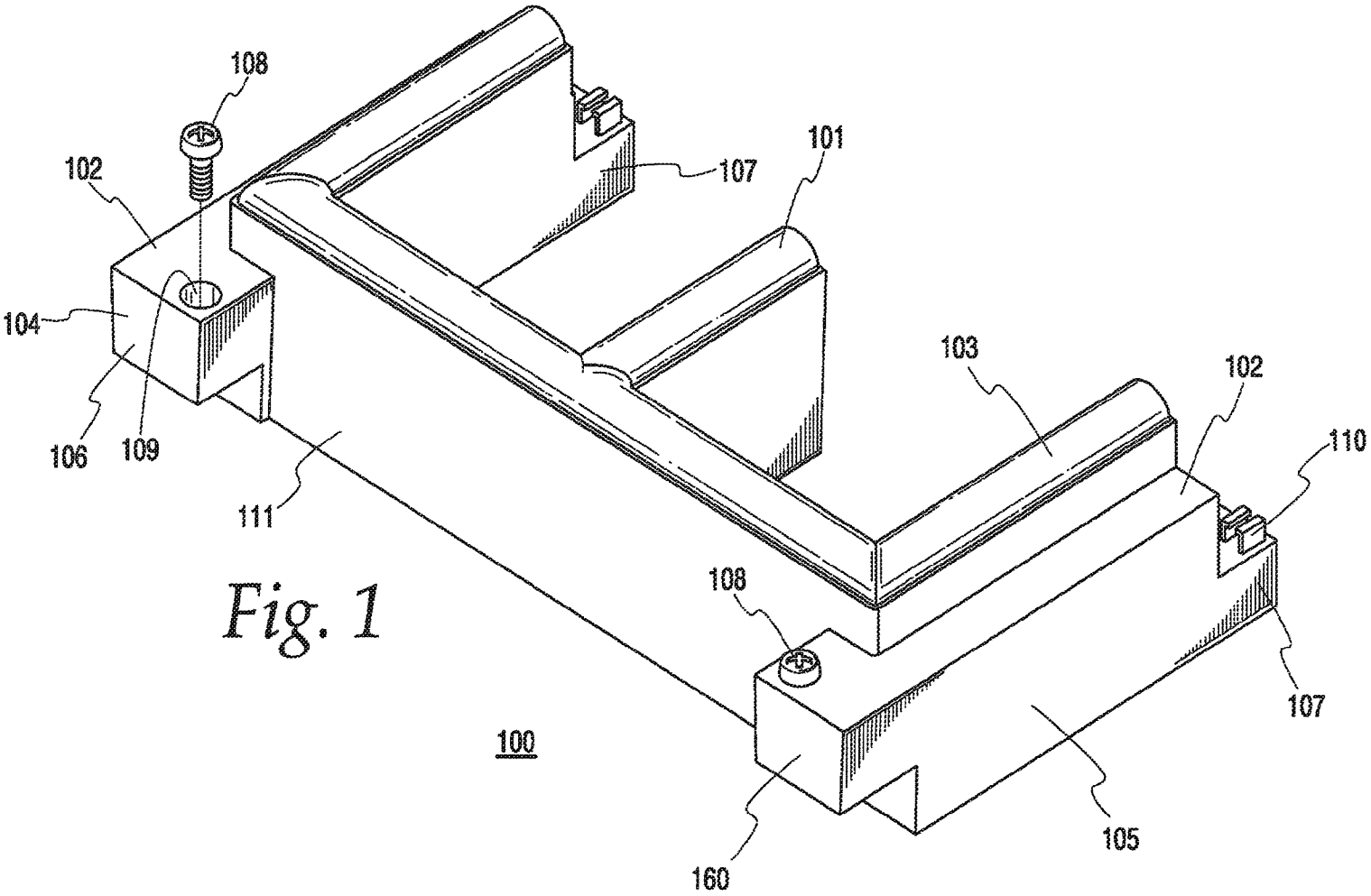
FIG. 1 comprises a perspective view as configured in accordance with various embodiments of the invention.

Elements in the figures are illustrated for simplicity and clarity but are nevertheless drawn to scale. Common but well-understood elements that are useful or necessary in a commercially feasible embodiment are sometimes not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a physically-discrete sign component comprises an internally-electrically-illuminated alphabetic character having a front-facing profile and at least one connecting bar disposed at least substantially horizontally with respect to the front-facing profile of the alphabetic character and at least partially within the front-facing profile of that alphabetic character. By one approach the internally-electrically-illuminated alphabetic character comprises a faux-neon internally-electrically-illuminated alphabetic character that is internally illuminated, for example, by a plurality of light-emitting diodes that are disposed behind a light diffuser having a form factor that conforms to the particular alphabetic character.

By one approach the physically-discrete sign component includes two of the connecting bars. If desired, these two connecting bars are disposed at least substantially parallel to one another. By one approach, a first one of the connecting bars extends partially, but not wholly, above an upper periphery of the aforementioned front-facing profile while the second connecting bar extends partially, but not wholly, below a lower periphery of the front-facing profile.

One of more of these connecting bars can have one or more bridging electrical conductors disposed therein. These bridging electrical conductors can comprise, for example, a positive electrical power rail and/or a negative electrical power rail.

By one approach the opposing ends of one or more of the aforementioned connecting bars include a connecting-bar interface that is configured to physically and electrically interconnect to another such connecting bar of an adjacent physically-discrete sign component. This connecting-bar interface can comprise, by one approach, a stepped interface that includes both a physical securement mechanism as well as an electrical connection. So configured, a number of such physically-discrete sign components can be readily and easily joined one to the other to form one or more words of interest. Accordingly, these physically-discrete sign components provide an inexpensive way to form custom internally-electrically-illuminated signs that are professional in appearance, effective for their intended purpose, and durable and flexible during use.

These and other benefits may become clearer upon making a thorough review and study of the following detailed description. Referring now to the drawings, and in particular to FIGS.

1 through 5, a physically-discrete sign component 100 that comports with many of these teachings will be described. It will be understood, however, that the specifics of this example are not to be taken as suggestions of any particular limitations in these various regards.

As one very simple example in these regards, FIGS. 1 through 5 depict a physically-discrete sign component 100 for an upper-case letter "E." In fact, these teachings are similarly applicable to a wide variety of alphanumeric characters including letters, numbers, punctuation marks, and any number of special characters (such as "@," "#," "$," "%," "&," and so forth). It will also be understood that these teachings will readily accommodate alphanumeric characters for written language systems other than standard English.

Figure 2:
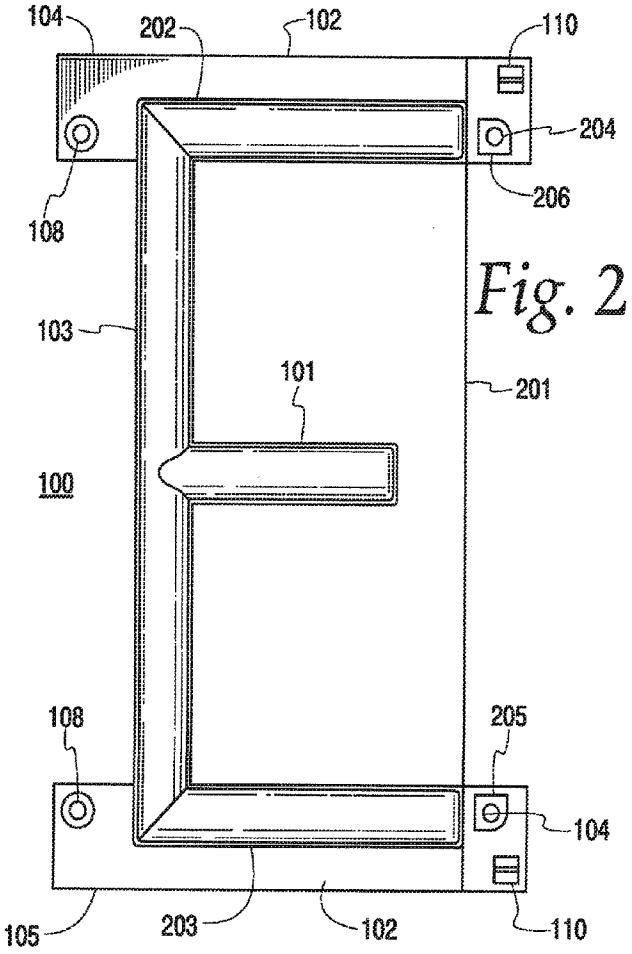
FIG. 2 comprises a front-elevational view as configured in accordance with various embodiments of the invention.
Figure 5:
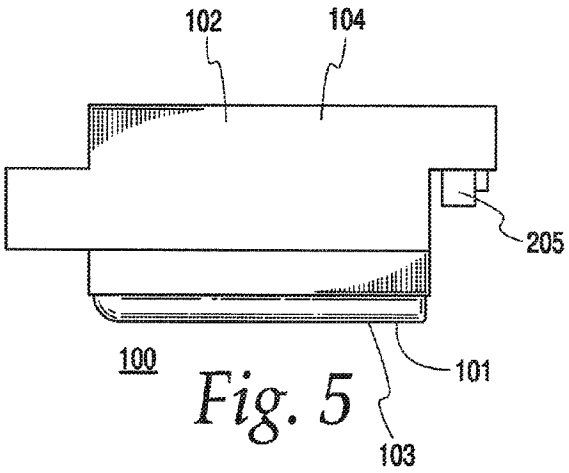
FIG. 5 comprises a top-plan view as configured in accordance with various embodiments of the invention.
Figure 4:
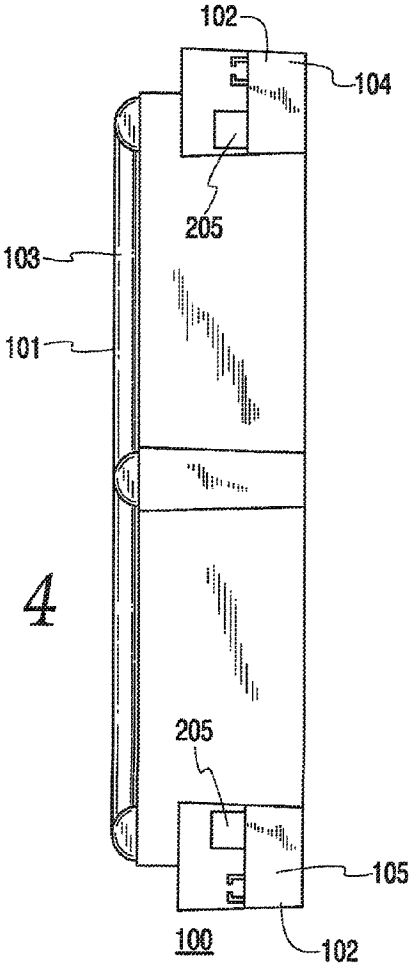
FIG. 4 comprises a side-elevational view as configured in accordance with various embodiments of the invention.

Generally speaking, each physically-discrete sign component 100 includes an internally-electrically-illuminated alphabetic character 101 and at least one connecting bar 102. The internally-electrically-illuminated alphabetic character 101 has a corresponding front-facing profile 201 (as illustrated in FIG. 2) that comprises a box that wholly includes a front view of the character 101. This box serves as a point of illustrative reference and it will be understood and appreciated that any given physically-discrete sign component 100 does not literally include such a box.

By one approach the internally-electrically-illuminated alphabetic character 101 comprises, in part, a light diffuser 103 having a form factor that conforms to the alphabetic character itself. In the example of FIGS. 1 through 5, for example, this light diffuser 103 has the shape of the letter "E." This light diffuser 103 can be comprised, for example, of a suitable translucent plastic material of choice and can have rounded upper surfaces as well.

Figure 6:
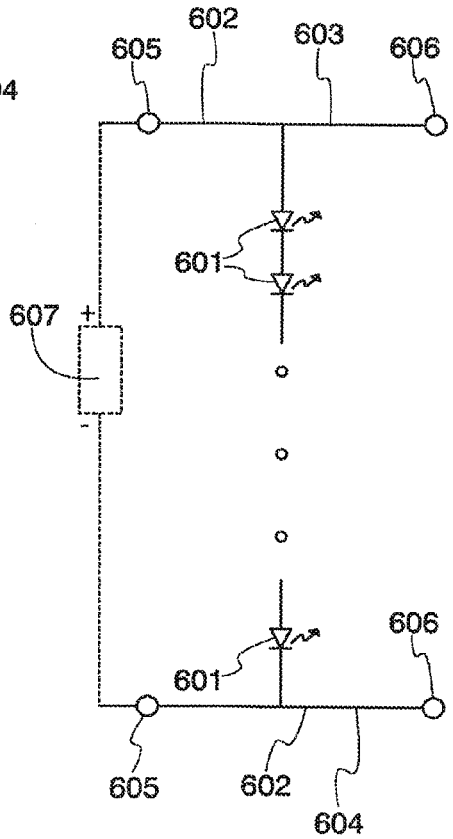
FIG. 6 comprises a schematic representation as configured in accordance with various embodiments of the invention.

By one approach, and referring momentarily to FIG. 6, the alphabetic character 101 can include a plurality of light sources 601 (such as, but not limited to, light-emitting diodes) that are aligned with and disposed behind the aforementioned light diffuser 103. These light sources 601 can be disposed as close to one another as may be desired. Examples in these regards include, but are not limited to, uniform spacing of about 0.5 inches, 1.0 inches, 1.5 inches, or any other distance of choice. These teachings will also accommodate non-uniform spacing if so desired.

These light sources 601 can be selected to emit essentially any color of choice, such as white, red, blue, and so forth. These teachings will also accommodate using multicolor light sources that will emit one of a plurality of available colors on a selective basis. The light diffuser 103 itself can also be colored as desired (which color may, or may not, match the color of the light being emitted by the light sources 601 as desired). As one simple example in these regards, the light sources 601 can emit a substantially white-colored light and the light diffuser 103 can comprise a reddish colored material.

These teachings are highly flexible in these regards, however, and will accommodate a variety of alternative approaches as regards the illuminated alphabetic character. For example, these teachings will readily accommodate the use of a luminous material (such as an organic light-emitting diode (OLED)) in lieu of the above-described light-emitting diodes coupled with a diffuser. In such a case, for example, the luminous material could be on the other surface of the structure that serves above as the diffuser. Alternatively, that luminous material could be disposed on the interior surface of a diffuser or other transparent cover having the appropriate letter shape.

So configured, and taking all of the foregoing into account, the internally-electrically-illuminated alphabetic character 101 can comprise a faux-neon internally-electrically-illuminated alphabetic character that visually mimics at least many of the visual accoutrements of a character formed using neon-lighting materials (such as a diffused, glowing style of lighting that is substantially uniform in color and intensity along the entire light-emitting surface).

These light sources 601 can be disposed within a channel or cavity that resides within a base 111 for each such alphabetic character 101. As shown in particular in FIG. 3, this base 111 can include a back surface 301 that is at least substantially planar. So configured, the physically-discrete sign component 100 can be readily disposed against a horizontal wall such that the back surface 301 is at least substantially flush with that horizontal wall. This base 111 can be formed of any desirable material include, for example, a suitable plastic. This base 111 can also be colored any desirable color. For many application settings, however, it will serve well for the base 111 to be colored black.

As noted earlier, each physically-discrete sign component 100 also includes at least one connecting bar 102. This connecting bar 102 is disposed at least substantially horizontally with respect to the aforementioned front-facing profile 201 of the alphabetic character 101 and also at least partially within that front-facing profile 201 of the alphabetic character 101. Accordingly, when viewed from the front (as illustrated, for example, in FIG. 2), the connecting bar 102 appears to the viewer as though it is behind the alphabetic character 101. While this foreground/background relationship may not be literally true in all embodiments, strictly speaking, it is at least this visual illusion to which this specification refers.

These teachings will readily accommodate more than one such connecting bar 102 per physically-discrete sign component 100 as desired. As illustrated, for example, there are two such connecting bars 102 that are disposed at least substantially parallel to one another. In particular, the illustrated embodiment includes both a top connecting bar 104 and a bottom connecting bar 105. In this example, (and referring in particular to FIG. 2) the top connecting bar 104 extends partially, but not wholly, above an upper periphery 202 of the front-facing profile 201 while the bottom connecting bar 105 extends partially, but not wholly, below a lower periphery 203 of the front-facing profile 201. Such a configuration is well suited to prompting the visual illusion described above.

A typical sign will usually include more than a single alphanumeric character. Accordingly, these physically-discrete sign components 100 are configured to readily connect, physically and electrically, in combination with one another. For example, in this illustrative example, each end of the connecting bars 102 comprises a connecting-bar interface that is configured to physically and electrically interconnect connecting bars 102 of separate physically-discrete sign components 100.

In this particular example these connecting-bar interfaces comprise, at least in part, a stepped interface. In particular, the left-side connecting-bar interface comprises an upper portion 106 while the right-side connecting-bar interface comprises a lower portion 107. These portions are sized to permit the upper portion 106 to fit snuggly and conformally above the lower portion 107 of an adjacent connecting-bar interface.

Also in this particular example the left-side connecting-bar interfaces include a threaded-engagement member 108 that fits within a corresponding hole 109. The right-side connecting-bar interface, in turn, includes a threaded-engagement member receiver 204 as shown in FIG. 2 in particular. So configured, the threaded-engagement members 108 (which can comprise, for example, screws) can mate with the threaded-engagement member receiver 204 of an adjacent physically-discrete sign component 100 to thereby physically secure one component 100 to another.

Figure 3:
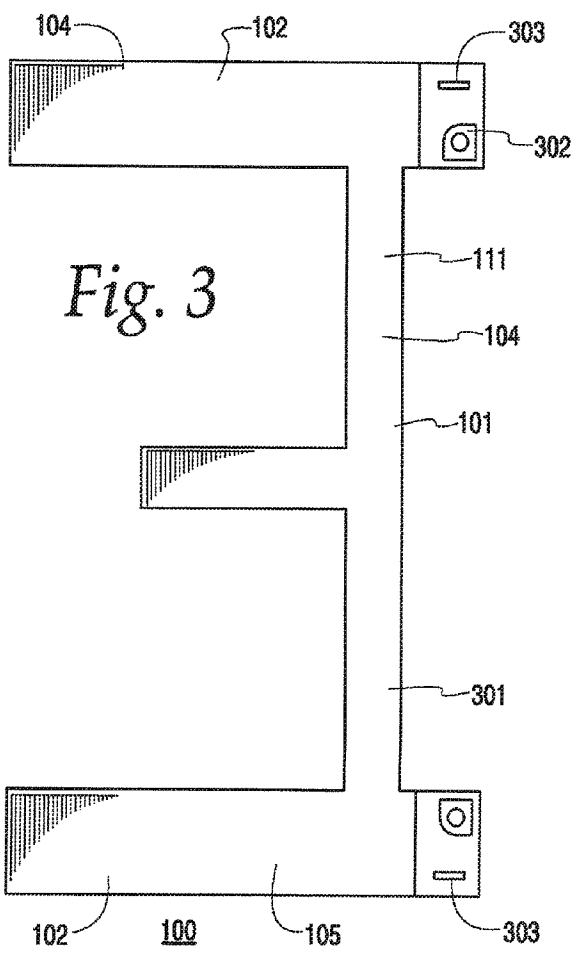
FIG. 3 comprises a rear-elevational view as configured in accordance with various embodiments of the invention.

By one approach, the threaded-engagement member receiver 204 can comprise a block 205 (which is particularly visible in FIGS. 4 and 5) that is sized and shaped to conformably fit within a corresponding opening 302 that corresponds to the location of the threaded-engagement member 108 (and which is particularly visible in FIG. 3). In this illustrative example the block 205 has a cross section that includes two orthogonal sides and a curved side. Such a shape can help to ensure a proper orientation and juxtapositioning of two physically-discrete sign components 100 when connecting one to the other.

To further assist in these regards, and as illustrated here, the elements that comprise the connecting-bar interfaces for the upper connecting bar 104 are essentially a mirror image of the corresponding elements as comprise the connecting-bar interface for the lower connecting bar 105. Such a configuration will discourage connecting the upper-connecting bar 104 of a first physically-discrete sign component 100 to the lower connecting bar 105 of a second physically-discrete sign component 100 and hence can help to ensure that the various components as comprise a given intended sign are properly joined one to the other.

By one approach, at least one of these connecting bars carries one or more electrical conductors to thereby provide power for the aforementioned light sources 601. In this illustrative example, and referring again momentarily to FIG. 6, each of the connecting bars 102 includes a bridging electrical conductor 602. More particularly, the bridging electrical conductor 603 (such as, for example, an electrically-conductive wire) is disposed within the upper connecting bar 104 and comprises a positive electrical power rail while the bridging electrical conductor 604 that is disposed within the lower connecting bar 105 comprises a negative electrical power rail. In this illustrative example, each of the bridging electrical conductors 602 includes an input port 605 and an output port 606. The input ports 605 serve to receive electrical power from a power source 607 and the output ports 606 serve to forward electrical power on to a next adjacent component 100.

Referring in particular now to FIGS. 2 and 3, the aforementioned input port 605 can comprise an exposed blade 303 of electrically-conductive material such as copper or a suitable copper alloy. The opposing connecting-bar interface includes a pair of inwardly-disposed arches 110 (comprised, for example, of plastic) that serve to receive and guide the aforementioned blade 303 to an electrically-conductive blade receiver (such as one or more electrically-conductive surfaces disposed on the inner surfaces of the aforementioned arches 110) and to also aid in securing and protecting that connection. So configured, an electrical connection can be easily and essentially automatically made between the bridging electrical conductors 602 of adjacent physically-discrete sign components 100. By one approach, if desired, this connection can be made sufficiently secure that the aforementioned threaded-securement members need not be used.

By one approach these electrical-connection components (i.e., the blade and the blade receiver) can themselves fit (more or less snuggly) into corresponding cavities (not shown) formed within the based 111 of the alphabetic character 101. These cavities can be readily formed, for example, when forming the based 111 using common injection molding techniques. In this case, and by way of further example, the back side of the base 111 can comprise a plate that is snapped into place or otherwise secured in place using, for example, screws or the like and which then restricts movement of the electrical-connection components to thereby hold those components in a desired orientation and location both during use and otherwise, so configured, the corresponding parts count and complexity of each such structure can be economically reduced.

Figure 7:
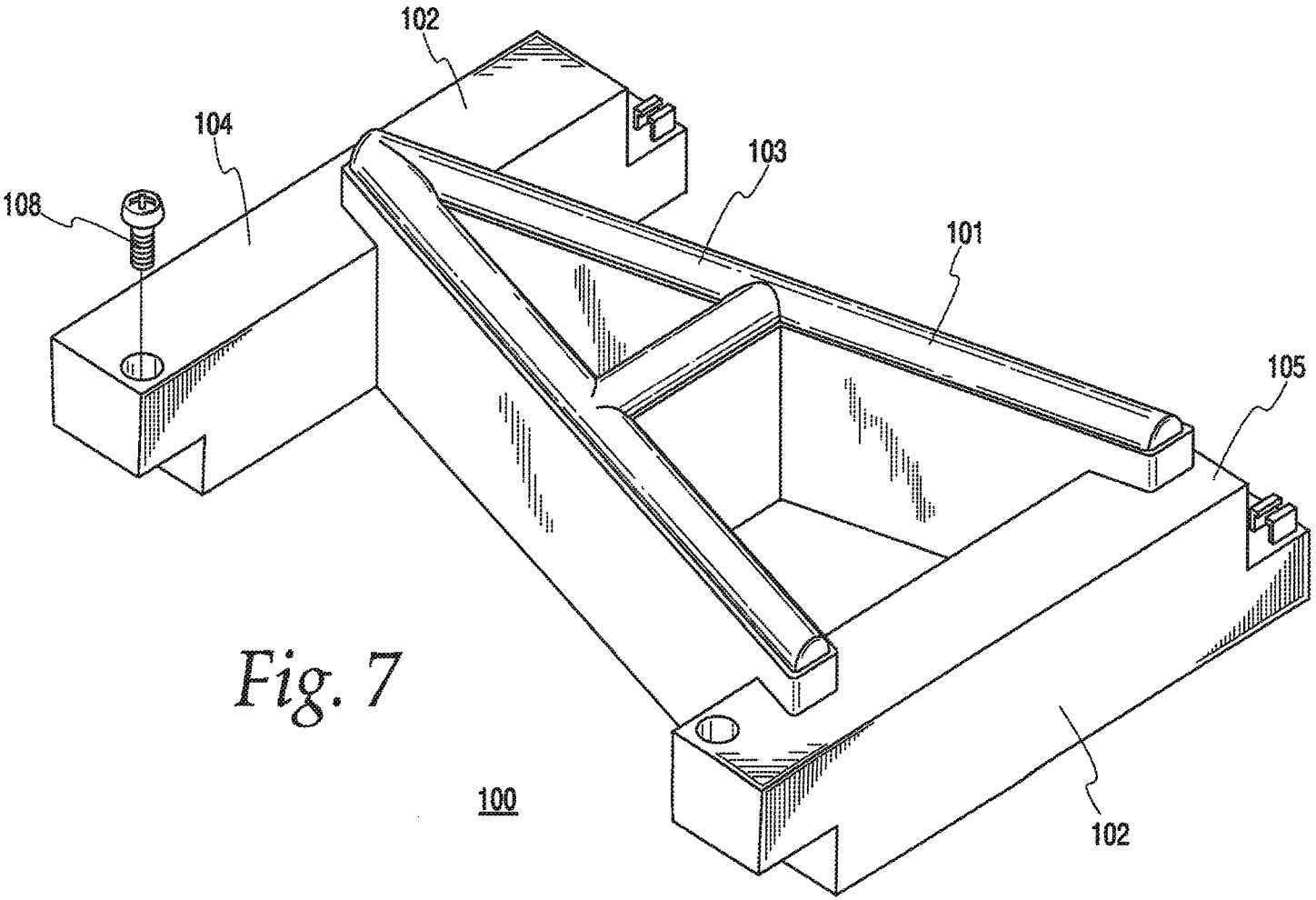
FIG. 7 comprises a perspective view as configured in accordance with various embodiments of the invention.

As noted above, a physically-discrete sign component 100 can comprise essentially any alphabetic character that one might wish, and that the approaches described above use the character "E" only as an illustrative example in these regards. FIG. 7 provides another example where the internally-electrically-illuminated alphabetic character 101 of the physically-discrete sign component 100 comprises an upper-case letter "A."

By one approach, both the height and width of the physically-discrete sign component 100 can be the same from one character to another. By another approach, however, the physically-discrete sign components 100 can have a front-facing profile 201 that have a proportional font-based width. In such a case the width of the front-facing profile 201 will vary with the respective and proportional needs of each character such that, for example, the physically-discrete sign component 100 for the letter "M" will be wider than the physically-discrete sign component 100 for the letter "I."

Figure 8:
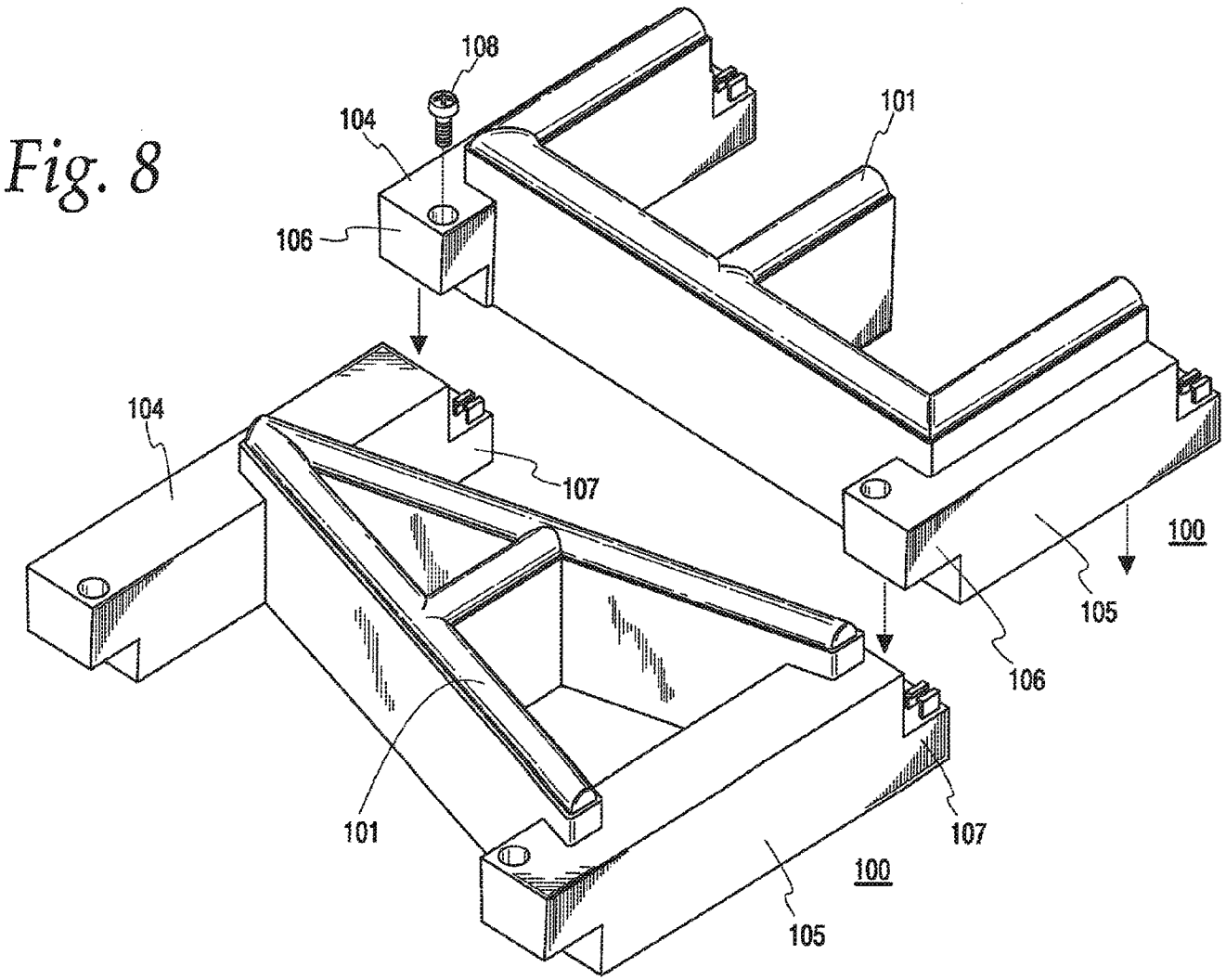
FIG. 8 comprises a perspective partially-exploded view as configured in accordance with various embodiments of the invention.
Figure 9:
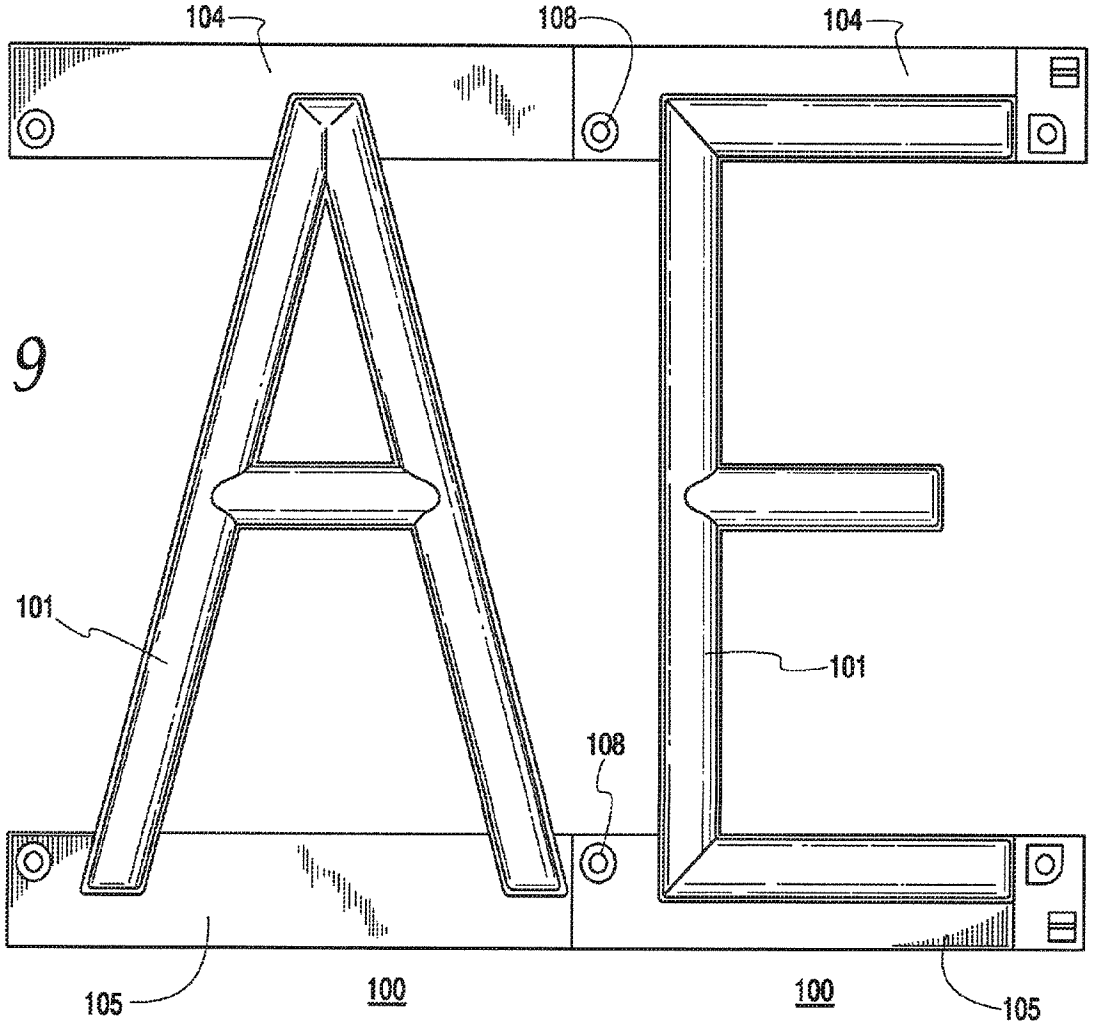
FIG. 9 comprises a front-elevational view as configured in accordance with various embodiments of the invention.

FIGS. 8 and 9 provide an illustrative example of a first physically-discrete sign component 100 for the letter "E" being connected to a second physically-discrete sign component 100 for the letter "A." As described above this connection is easily achieved by simply aligning the upper and lower connecting bars 104 and 105 of the two physically-discrete sign components 100 with one another such that the respective connecting-bar interfaces physically and electrically mate with one another. The aforementioned threaded-engagement members 108 can then secure the two physically-discrete sign components 100 to one another. Additional physically-discrete sign components 100 can be included in a similar manner to construct a character-based message of choice.

Figure 10:
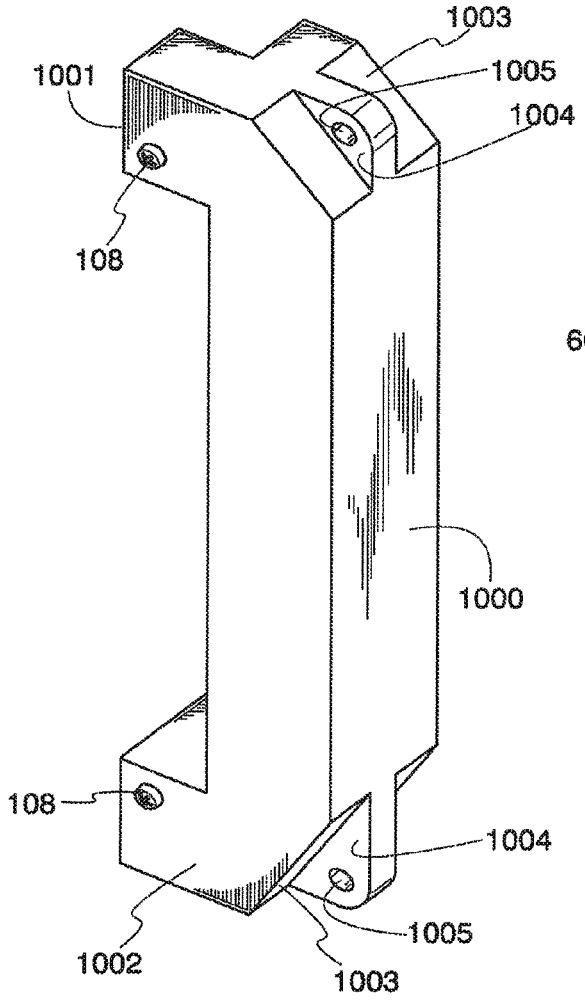
FIG. 10 comprises a perspective view as configured in accordance with various embodiments of the invention.

These teachings will further accommodate the use of one or more endcaps if desired. FIG. 10 provides an illustrative example of a terminating end cap 1000 that is configured and arranged to connect to the right sides of the upper and lower connecting bars 104 and 105. This terminating end cap 1000 includes connecting-bar interfaces 1001 and 1002 as described above to facilitate connecting the terminating end cap 1000 to a physically-discrete sign component 100. In this case, however, as the terminating end cap 1000 includes no bridging electrical conductors the connecting-bar interfaces 1001 and 1002 need not include any electrical conductors.

In this illustrative example the terminating end cap 1000 has beveled corners 1003 to accommodate corresponding flanges 1004 that in turn have a hole 1005 disposed there through. These holes 1005 can provide a way, for example, to hang a completed sign using a wire, cable, rope, string, chain, or the like.

Figure 11:
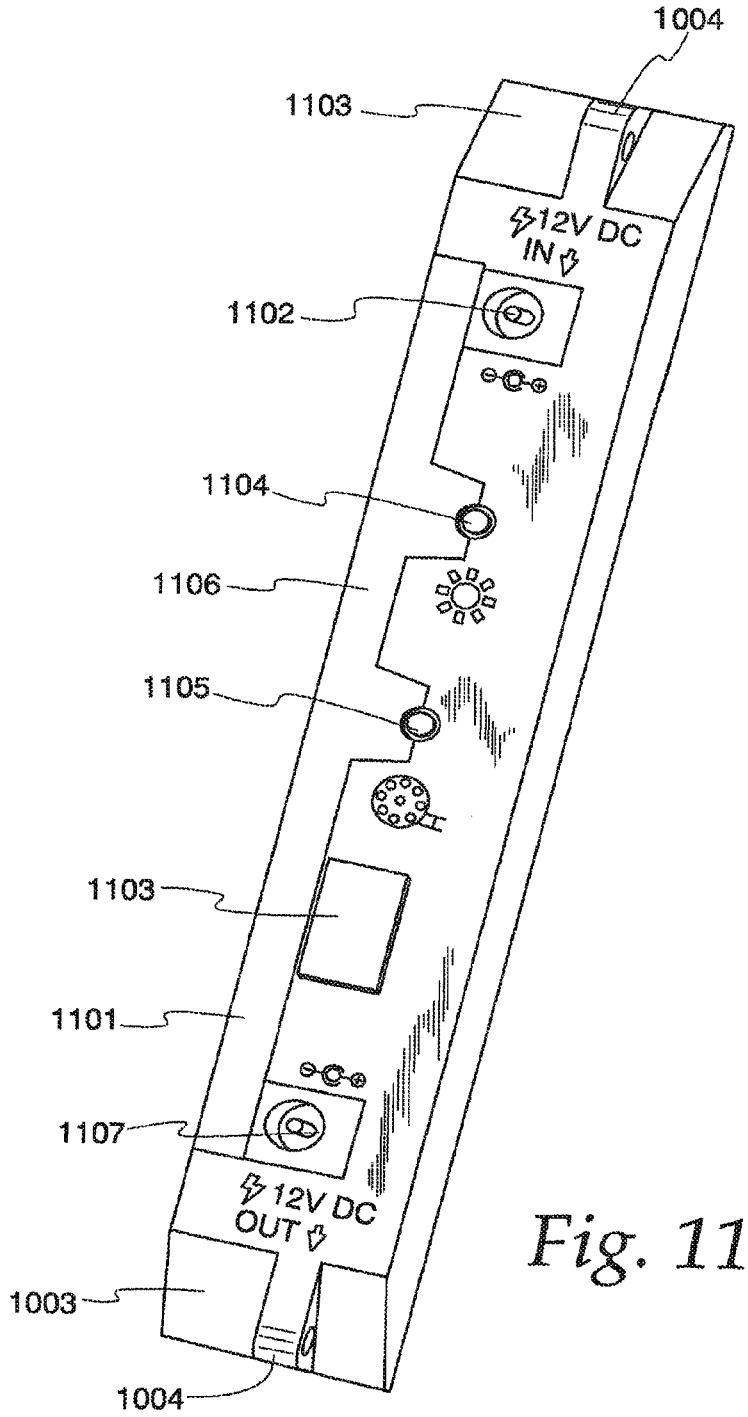
FIG. 11 comprises a perspective view as configured in accordance with various embodiments of the invention.

FIG. 11 provides an illustrative view of an end cap 1101 similarly configured to connect to the left side of a corresponding physically-discrete sign component 100. Like the terminating end cap 1000 this end cap 1101 can also have beveled corners 1003 to thereby similarly accommodate flanges 1004 having holes 1005 disposed there through to facilitate hanging a completed sign.

This end cap 1101 also includes some electrical connectors and switches. In particular, this end cap 1101 includes a power-input interface 1102 to facilitate connecting the above-described circuitry to a source of DC power (such as a battery or a transformer-based power supply as are known in the art) and a power-output interface 1107 to facilitate using an appropriate bridging power line to connect that DC power to the power-input interface of another such end cap 1101. So configured, a plurality of discrete multi-component signs can be electrically linked one to the other to facilitate powering those multiple signs using only a single power source.

This end cap 1101 also includes, in this illustrative example, a master power on/off switch 1103 and two additional buttons 1104 and 1105. The first button 1104 can serve, for example, to step a control circuit (not shown) through a variety of brightness levels for the light sources 601 ranging, for example, from dim to very bright. Pulse-width modulation can facilitate such actions as will be well understood by those skilled in the art. The second button 1105, in turn, can serve to step that control circuit through a variety of show settings. For example, a first setting can provide for maintaining the light sources 601 at a constant illumination while a second setting can provide for blinking the light sources 601 on and off at some particular rate. These teachings will accommodate a wide variety of possibilities in these regards.

In this particular example these interfaces and switches are disposed on a side edge 1106 of the end cap 1101. Such a position provides convenient access to these components while also keeping the front of the completed sign unadorned in these regards. Side-mounting these interfaces and switches also avoids locating them on the backside of the physically-discrete sign component 100 which, in turn, helps assure that the completed sign will rest flush against a supporting wall.

Figure 12:
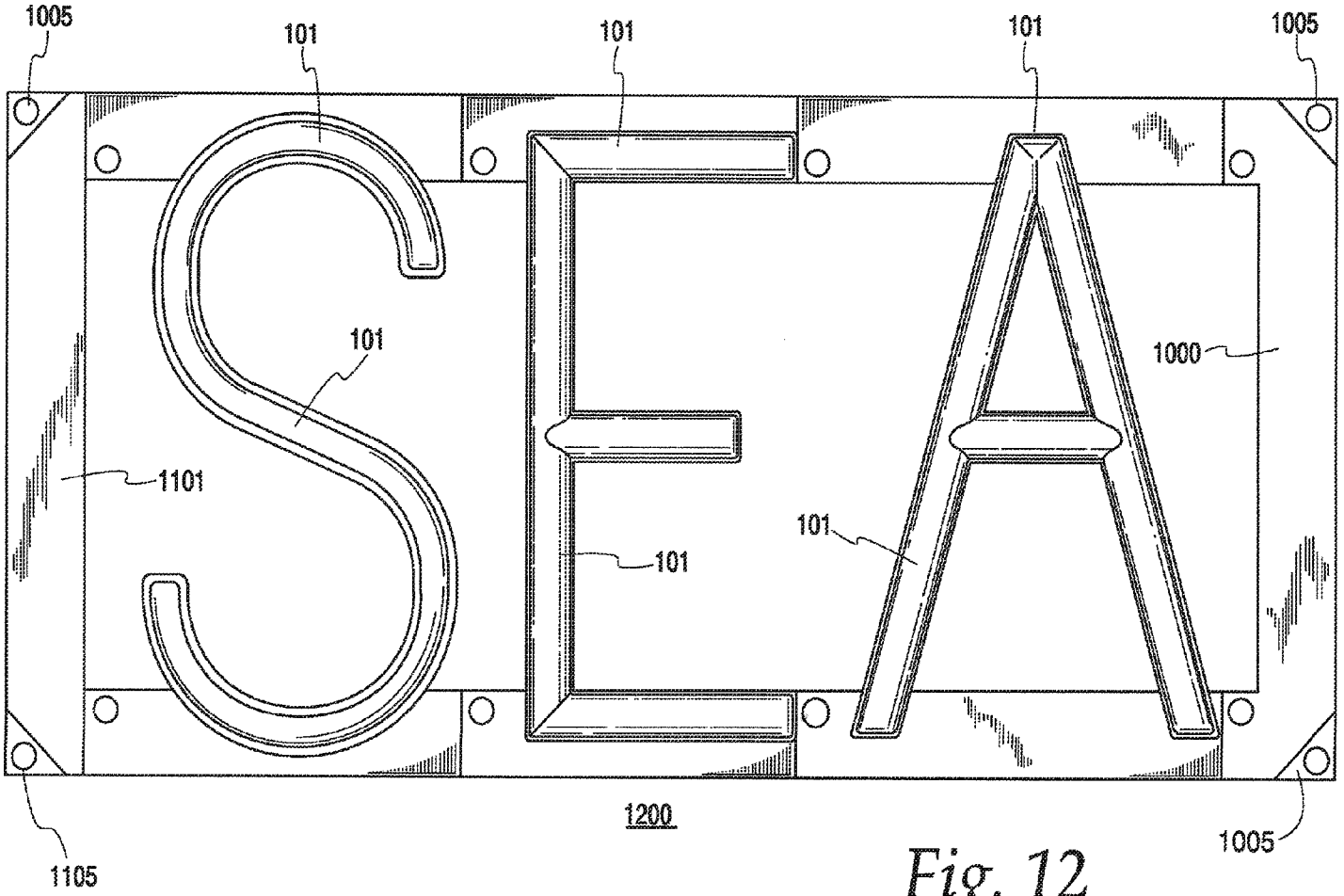
FIG. 12 comprises a front-elevational view as configured in accordance with various embodiments of the invention.

FIG. 12 provides an illustrative example of a simple completed sign 1200 that includes three physically-discrete sign components 100 (one each for the characters "S," "E," and "A") and the two aforementioned end caps 1000 and 1101. Such a sign 1200 can be mounted or positioned in any of a variety of ways. Examples include hanging the sign 1200 using a wire or the like that connects to the two upper corner holes 1005 (either in free space or resting against a wall) and simply setting the sign 1200 atop a horizontal surface such as a tabletop. Additional signs (not shown) could be easily hung below this sign 1200 by use of the holes 1005 disposed in the bottom corners of the sign 1200.

So configured, a custom sign can be easily constructed by merely attaching the physically-discrete sign components 100 for the desired characters in a desired order. The attachment as described serves to both physically and electrically connect one physically-discrete sign component 100 to another. The end caps 1000 and 1101, in turn, provide further structural support, useful electrical connections, and a complimentary aesthetic.

The relative positioning of the alphabetic characters themselves with respect to the connecting bars in particular provides an attractive aesthetic appearance while also contributing to the overall strength and resiliency of the assembled sign 1200.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one simple example in these regards, physically-discrete sign components can be provided that include more than one alphabetic character if desired. For example, a given physically-discrete sign component might comprise the expression "AND/OR" or the suffix ".COM."

We claim:

1. An apparatus comprising:

a physically-discrete sign component including:

an internally-electrically-illuminated alphabetic character having a front-facing profile;

at least one connecting bar disposed at least substantially horizontally with respect to the front-facing profile of the alphabetic character and at least partially within the front-facing profile of the alphabetic character, the connecting bar being configured to attach directly to the connecting bar of an adjacent one of the physically-discrete sign components to thereby form a multi-component sign.

2. The apparatus of claim 1 wherein the alphabetic character comprises, at least in part, a light diffuser having a form factor that conforms to the alphabetic character, the apparatus further comprising:

a plurality of light-emitting diodes disposed behind the light diffuser.

3. The apparatus of claim 2 wherein at least some of the physically-discrete sign components have a front-facing profile having a proportional font-based width.

4. The apparatus of claim 1 wherein the physically-discrete sign component includes at least two of the connecting bars.

5. The apparatus of claim 4 wherein the two connecting bars are disposed at least substantially parallel to one another.

6. The apparatus of claim 5 wherein a first one of the connecting bars extends partially, but not wholly, above an upper periphery of the front-facing profile while a second one of the connecting bars extends partially, but not wholly, below a lower periphery of the front-facing profile.

7. The apparatus of claim 4 wherein the two connecting bars each include a bridging electrical conductor.

8. The apparatus of claim 7 wherein a first one of the bridging electrical conductors comprises a positive electrical power rail and a second one of the bridging electrical conductors comprises a negative electrical power rail.

9. The apparatus of claim 8 wherein both the first and second connecting bars each include a connecting-bar interface configured to physically and electrically interconnect to another such connecting bar of another physically-discrete sign component.

10. The apparatus of claim 9 wherein the connecting-bar interfaces for the first connecting bar are at least substantially a mirror image of the connecting-bar interfaces for the second connecting bar to thereby discourage connecting the first connecting bar to a second connecting bar of another of the physically-discrete sign components.

11. The apparatus of claim 9 wherein the connecting-bar interfaces include at least one of an electrically-conductive blade and an electrically-conductive blade receiver.

12. The apparatus of claim 9 wherein the connecting-bar interfaces include at least one of a threaded-engagement member and a threaded-engagement member receiver.

13. The apparatus of claim 9 further comprising:

at least one end cap configured and arranged to connect to at least one of the connecting-bar interfaces.

14. The apparatus of claim 13 wherein the end cap includes, at least in part:

a power-input interface;

a power-output interface;

a power on/off switch.

15. The apparatus of claim 14 wherein the power-input interface, the power-output interface, and the power on/off switch are disposed on a side edge of the end cap.

16. The apparatus of claim 14 further comprising another end cap that does not include a power-input interface, a power-output interface, and a power on/off switch.

17. An apparatus comprising:

a physically-discrete sign component including:

an internally-electrically-illuminated alphabetic character having a front-facing profile;

at least one connection point disposed outward of each opposing lateral side of the front-facing profile of the alphabetic character, the at least one connection point including a bridging electrical conductor and being configured to physically and electrically couple to another, laterally-adjacent one of the physically-discrete sign components via the connection points.

18. The apparatus of claim 17 wherein there are at least two of the connections points disposed laterally outward of each opposing lateral side of the front-facing profile of the alphabetic character.

19. The apparatus of claim 17 wherein the connection points on each opposing lateral side of the front-facing profile of the alphabetic character comprise opposing ends of a bar.

20. The apparatus of claim 19 wherein the bar comprises a substantially horizontal bar.

* * * * *